US009031490B2

(12) United States Patent
Ogura

(10) Patent No.: US 9,031,490 B2
(45) Date of Patent: May 12, 2015

(54) CARTRIDGE INCLUDING RESTRICTION PORTIONS CONFIGURED TO BE ATTACHABLE TO COMPRESSION COIL SPRINGS COMPRESSED TO PRESS A CLEANING BLADE TO AN IMAGE BEARING MEMBER

(71) Applicant: Canon Kabushiki Kaisha, Tokyo (JP)

(72) Inventor: Motohiro Ogura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 13/739,469

(22) Filed: Jan. 11, 2013

(65) Prior Publication Data

US 2013/0195529 A1 Aug. 1, 2013

(30) Foreign Application Priority Data

Jan. 27, 2012 (JP) ..... 2012-014901

(51) Int. Cl.
*G03G 21/00* (2006.01)

(52) U.S. Cl.
CPC ..... *G03G 21/0011* (2013.01); *G03G 21/0029* (2013.01)

(58) Field of Classification Search
USPC ..... 399/350–351
See application file for complete search history.

(56) References Cited

U.S. PATENT DOCUMENTS

| | | | | |
|---|---|---|---|---|
| 4,595,280 | A * | 6/1986 | Tanzawa et al. | 399/345 |
| 5,659,865 | A * | 8/1997 | Zarbo | 399/327 |
| 5,812,918 | A * | 9/1998 | Nakaue et al. | 399/284 |
| 6,128,461 | A * | 10/2000 | Yoshikawa | 399/350 |
| 6,459,866 | B1 * | 10/2002 | Meguro | 399/102 |
| 6,721,533 | B2 * | 4/2004 | Sato et al. | 399/350 |
| 7,272,344 | B2 * | 9/2007 | Miura et al. | 399/159 |
| 7,289,759 | B2 | 10/2007 | Ogura | |
| 7,711,286 | B2 * | 5/2010 | Oda et al. | 399/102 |
| 2002/0025181 | A1 * | 2/2002 | Meguro | 399/102 |
| 2002/0110748 | A1 * | 8/2002 | Oshiba et al. | 430/125 |
| 2002/0137607 | A1 * | 9/2002 | Endelman | 482/123 |
| 2008/0063448 | A1 * | 3/2008 | Hozumi et al. | 399/350 |
| 2010/0067945 | A1 * | 3/2010 | Hozumi et al. | 399/111 |
| 2010/0067949 | A1 * | 3/2010 | Watanabe et al. | 399/123 |
| 2011/0097104 | A1 * | 4/2011 | Sueoka | 399/101 |
| 2013/0064589 | A1 * | 3/2013 | Thayer | 399/351 |
| 2013/0189010 | A1 * | 7/2013 | Takei | 399/350 |
| 2013/0189011 | A1 * | 7/2013 | Matsumura | 399/350 |
| 2013/0223872 | A1 * | 8/2013 | Aiba et al. | 399/101 |

FOREIGN PATENT DOCUMENTS

| | | | |
|---|---|---|---|
| JP | 11-38846 | A | 2/1999 |
| JP | 2008-233319 | A | 10/2008 |
| JP | 2010-72116 | A | 4/2010 |

* cited by examiner

*Primary Examiner* — G. M. Hyder
(74) *Attorney, Agent, or Firm* — Fitzpatrick, Cella, Harper & Scinto

(57) ABSTRACT

As a typical configuration of a cleaning device and an image forming apparatus according to the invention, the cleaning device includes a cleaning blade which cleans an image bearing member, a plurality of compression coil springs which apply a force from the cleaning blade to the image bearing member, and a plurality of bosses provided to fix the plurality of compression coil springs to a frame. The particular boss that attaches to one of the compression coil springs is selectable from the plurality of bosses, which are disposed at different positions. As a result, the abutting pressure of the cleaning blade to the image bearing member is adjustable by changing the boss to which a particular compression spring is attached.

7 Claims, 10 Drawing Sheets

FIG. 10

| | EXAMPLE 1 | EXAMPLE 2 | EXAMPLE 3 | COMPARATIVE EXAMPLE 1 | COMPARATIVE EXAMPLE 2 | COMPARATIVE EXAMPLE 3 | COMPARATIVE EXAMPLE 4 |
|---|---|---|---|---|---|---|---|
| STRUCTURE OF SPRING | COMPRESSION COIL SPRING | COMPRESSION COIL SPRING | COMPRESSION COIL SPRING | TENSION COIL SPRING | COMPRESSION COIL SPRING | COMPRESSION COIL SPRING | COMPRESSION COIL SPRING |
| FORMING OF SPRING | FRONT END INCLINED BY 15° | FRONT END INCLINED BY 15° | FRONT END INCLINED BY 15° | FRONT END INCLINED BY 15° | FRONT END INCLINED BY 15° | FRONT END INCLINED BY 15° | FLAT FRONT END OF 0° |
| FRAME BODY | PRESENCE OF BOSS | BOSS + BOTTOM RAISING MEMBER | PRESENCE OF BOSS | NON-PRESENCE OF BOSS | NON-PRESENCE OF BOSS | PRESENCE OF BOSS | PRESENCE OF BOSS |
| SPRING CONSTANT | SAME | SAME | CHANGED | SAME | SAME | SAME SPACE | SAME SPACE |
| Δ OF PRESSURE | 0.05 | 0.02 | 0.05 | 0.40 | 0.20 | 0.25 | 1.25 |
| ASSEMBLING WORKABILITY | ○ | ○ | ○ | ○ | ○ | ○ | × |
| IMAGE RESULT | ○ | ◎ | ○ | × | × | △ | × |

CARTRIDGE INCLUDING RESTRICTION PORTIONS CONFIGURED TO BE ATTACHABLE TO COMPRESSION COIL SPRINGS COMPRESSED TO PRESS A CLEANING BLADE TO AN IMAGE BEARING MEMBER

BACKGROUND OF THE INVENTION

1. Field of the Invention

The present invention relates to a cleaning device that is used in an image forming apparatus such as a printer, a copying machine, and a facsimile.

2. Description of the Related Art

In a recent image forming apparatus, there has been an attempt to extend the life of the apparatus by suppressing the amount of scraping of a photosensitive drum (image bearing member) to be ¼ of the scraping amount of the related art. When the scraping amount becomes ¼ or less of the scraping amount of the related art, the life of the apparatus, which is normally sufficient to print thirty thousand sheets to seventy thousand sheets in the related art, increases to be sufficient to print one hundred twenty thousand sheets to three hundred thousand sheets.

During such an extended life of the apparatus, even in a cleaning device that cleans a photosensitive drum, a cleaning blade needs to be stably pressed against the photosensitive drum to ensure a long life time. As this configuration, there is proposed a configuration in which a tension coil spring is hooked to the end of a metal sheet of the cleaning blade so as to equalize the pressure (see Japanese Patent Laid-Open No. 11-38846).

However, Japanese Patent Laid-Open No. 11-38846 discloses a configuration in which the tension coil spring is hooked to the end of the metal sheet of the cleaning blade so as to press the cleaning blade against the photosensitive drum. For this reason, the center pressure of the cleaning blade in the longitudinal direction is weakened, so that the scraping becomes uneven due to the difference in the scraping amount between the center and the end of the photosensitive drum. In particular, in a recent high-quality image forming apparatus, the slight uneven scraping leads to a defective image, and hence the image of the uneven scraping appears as shading when outputting a halftone uniform image.

It is thus desirable to provide a cleaning device capable of adjusting the pressure distribution in the longitudinal direction while equalizing the pressure from a cleaning blade to an image bearing member for a long period of time with a simple configuration, and to provide an image forming apparatus including the same.

SUMMARY OF THE INVENTION

In order to solve the above-described problems, according to an aspect of the invention, there is provided a cartridge including: a frame body; a cleaning blade which is provided movably inside the frame body and cleans an image bearing member; a plurality of compression coil springs which are compressed so as to press the cleaning blade to the image bearing member; and a plurality of restricting portions, the number of which is larger than the number of compression coil springs, that are attached to the plurality of compression coil springs, and restrict the positioning of the compression coil springs. A restricting portion provided with a plurality of compression coil springs is selectable from the plurality of restricting portions.

According to the aspect of the invention, it is possible to provide the cleaning device capable of adjusting the pressure distribution in the longitudinal direction while equalizing the pressure from the cleaning blade to the image bearing member for a long period of time with a simple configuration and the image forming apparatus including the same.

Further features of the present invention will become apparent from the following description of exemplary embodiments with reference to the attached drawings.

BRIEF DESCRIPTION OF THE DRAWINGS

FIG. 10 is a diagram illustrating a test result of Examples 1 to 3 using the invention and Comparative Examples 1 to 4.

DESCRIPTION OF THE EMBODIMENTS

Figure 1:
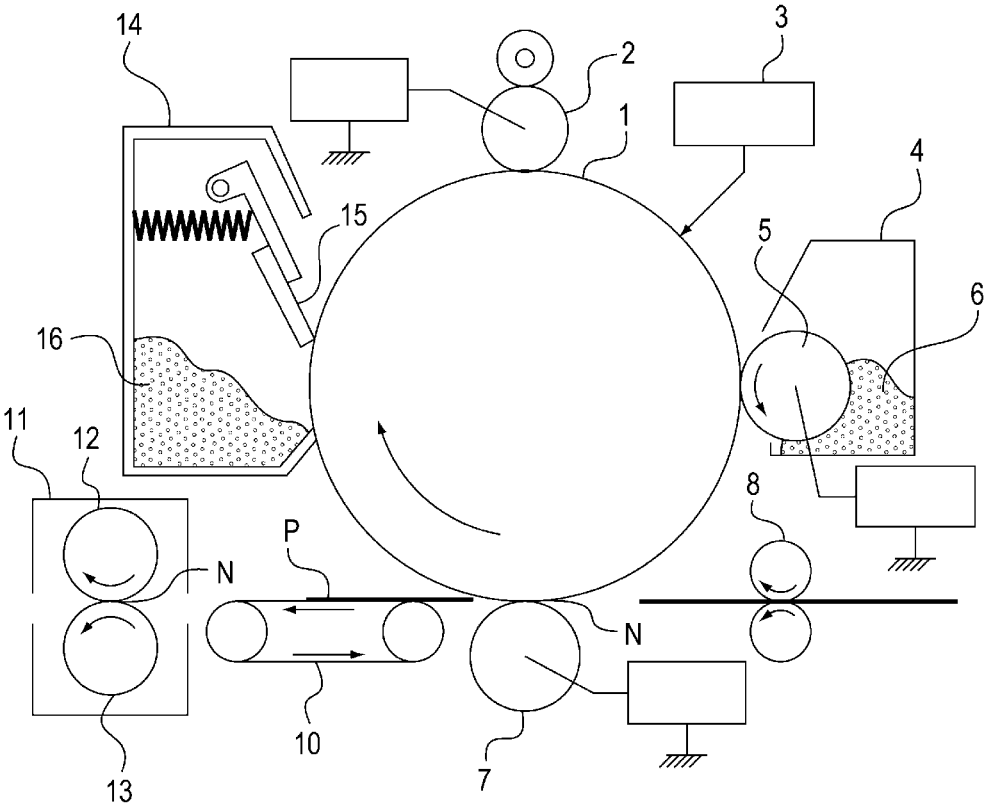
FIG. 1 is a configuration diagram illustrating an image forming apparatus according to an embodiment.

FIG. 1 is a configuration diagram illustrating an image forming apparatus 100 according to an embodiment. As illustrated in FIG. 1, in the image forming apparatus 100 of the embodiment, a photosensitive drum (image bearing member) 1 is evenly charged to a predetermined polarity and a predetermined charge by a charging roller 2. The charged photosensitive drum 1 is exposed to a laser beam corresponding to image information by an exposure device 3, so that an electrostatic latent image is formed thereon.

The electrostatic latent image which is formed on the photosensitive drum 1 is developed as a toner image using a toner by a developing device 4. In the developing device 4, a developing sleeve 5 conveys the toner which is received in a hopper portion 6 to the photosensitive drum 1.

Meanwhile, a sheet P which is received in a tray (not illustrated) is conveyed to a transfer portion T as a nip portion between the photosensitive drum 1 and a transfer roller 7 by a feeding roller (not illustrated) and a registration roller 8, so that the toner image is transferred onto the sheet. The sheet P to which the toner image is transferred is conveyed to a fixing device 11 by a conveyor belt 10, is heated and pressurized at a fixing portion N as a nip portion between a heating roller 12 and a pressure roller 13, so that the toner image is fixed onto the sheet, and then is discharged to the outside of the image forming apparatus.

Meanwhile, after the toner image is transferred onto the sheet P, residual matter such as a residual toner and a paper dust left on the photosensitive drum 1 is removed by a cleaning blade 15 of a cleaning device 14 and is received in a recycled toner receiving portion 16.

Figure 2:
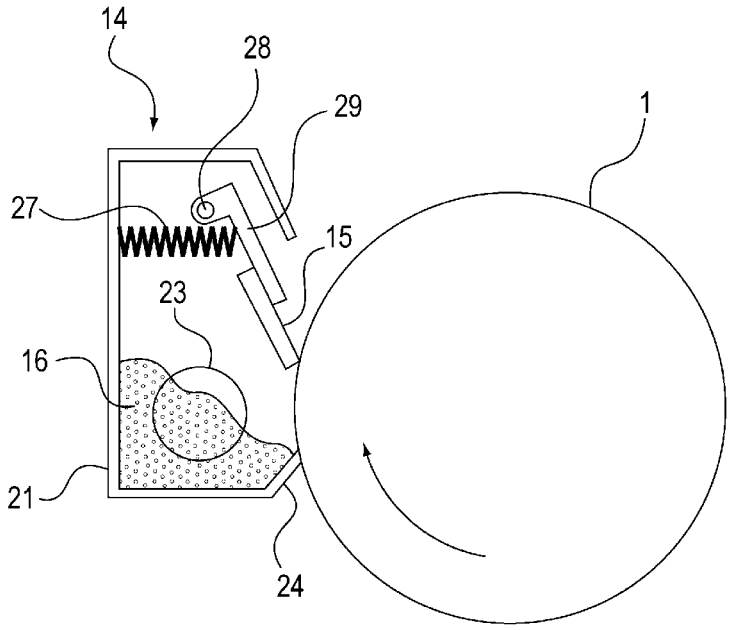
FIG. 2 is a configuration diagram illustrating a cleaning device according to the embodiment.

(Cleaning device 14) FIG. 2 is a configuration diagram illustrating the cleaning device 14. As illustrated in FIG. 2, the cleaning device 14 includes a frame body 21, the cleaning blade 15, a swing shaft 28, a metal sheet 29, a plurality of compression coil springs 27, a waste toner conveying screw 23, and a toner scattering prevention sheet 24.

The cleaning blade 15 is fixed to the metal sheet 29. The metal sheet 29 is rotatable about the swing shaft 28. The compression coil spring 27 is provided between the frame body 21 and the metal sheet 29, and applies a force to the metal sheet 29, so that the cleaning blade 15 is pressed against the photosensitive drum 1.

The cleaning blade 15 abuts against the surface of the photosensitive drum 1 in the counter direction, and scrapes a residual toner remaining on the photosensitive drum 1, and collects the toner into the frame body 21. The collected residual toner is prevented from leaking to the outside of the cleaning device 14 by the toner scattering preventing sheet 24.

As the material of the cleaning blade 15, any material with appropriate elasticity and hardness may be used. In general, for example, elastomer such as polyurethane, styrene-butadiene copolymer, chloroprene, butadiene rubber, ethylene-propylene-diene-based rubber, chlorosulfonated polyethylene rubber, fluorine rubber, silicone rubber, acrylic rubber, two tolyl rubber, and chloroprene rubber may be exemplified.

As the material of the cleaning blade 15, in particular, desirable is polyurethane which does not damage the photosensitive drum due to a friction and has large abrasion resistance. Further, two-liquid thermosetting polyurethane material may be used in consideration of small permanent deformation. As a curing agent, a general urethane curing agent such as 1,4-butanediol, 1,6-hexanediol, hydroquinone diethylol ether, bisphenol A, trimethylolpropane, and trimethylolethane may be used.

It is desirable that the cleaning blade 15 have high hardness (JIS-A), such as 65 to 80° and more particularly 70 to 77° are desirable. There is a problem in an apparatus with a long life using a cleaning blade 15 with a hardness lower than 65°. In such an apparatus using such a cleaning blade 15, when the cleaning blade 15 is used for a long period of time, the front end of the cleaning blade 15 is rounded, so that the cleaning performance is degraded. Further, when the cleaning blade 15 is used for a long period of time at a hardness higher than 80°, the cleaning blade 15 collapses (falls down). For this reason, the pressure that is applied from the cleaning blade 15 to the photosensitive drum 1 does not become even in the longitudinal direction of the cleaning blade 15.

As the material of the compression coil spring 27, a general metal such as iron, copper, and SUS is desirable. It is desirable that the spring constant of the compression coil spring 27 be 0.4 to 2.7 N/mm. When the spring constant becomes smaller than 0.4 N/mm, trouble occurs in the cleaning performance. When the spring constant becomes larger than 2.7 N/mm, the pressure is strengthened, so that the cleaning blade 15 is curved. Accordingly, the cleaning operation is performed at the body instead of the edge, so that trouble occurs in the cleaning performance.

The diameter of the compression coil spring 27 may be 1 to 10 mm and desirably, 2 to 8 mm. When the diameter is smaller than 1 mm, the compression coil spring 27 is thinned, so that a stable force cannot be applied to the metal sheet 29. When the diameter is larger than 10 mm, the pressure weighted range increases, so that the unevenness in the pressure increases. Specifically, when the diameter of the compression coil spring 27 is set to 1 to 10 mm and desirably, 2 to 8 mm, a stable force may be applied to the cleaning blade 15, so that the unevenness in the pressure may be suppressed.

Figure 3A:
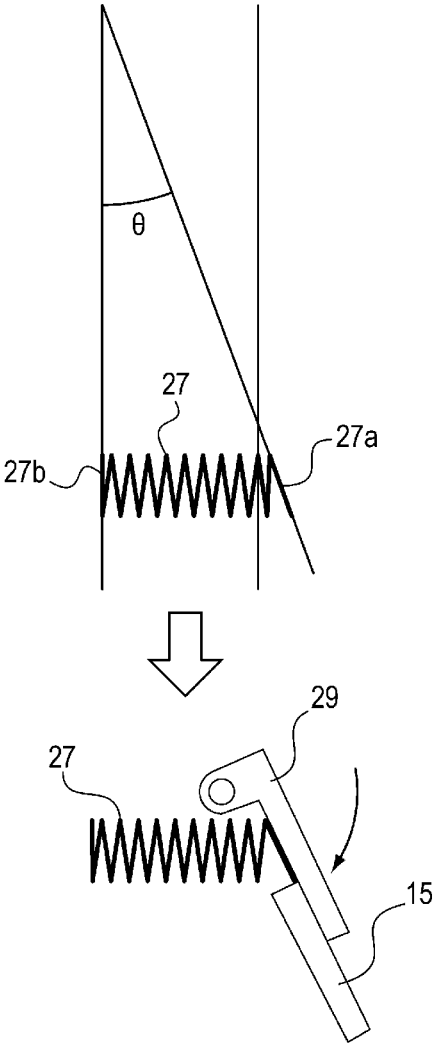
FIGS. 3A and 3B are diagrams illustrating a compression coil spring according to the embodiment.
Figure 3B:
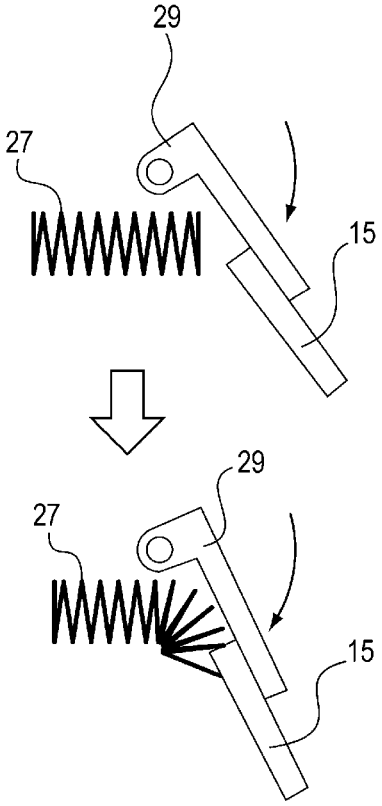

FIG. 3A is a diagram illustrating a compression coil spring according to the embodiment. FIG. 3B is a diagram illustrating a compression coil spring as Comparative Example. As illustrated in FIG. 3A, in the compression coil spring 27 of the embodiment, a front end (a bearing surface) 27*a* of the compression coil spring 27 is formed so as to be inclined with respect to the longitudinal direction of the compression coil spring 27, and the front end 27*a* applies a force to the metal sheet 29 in a direction substantially perpendicular thereto. That is, at least one of bearing surfaces of the compression coil spring 27 is formed so as to be inclined with respect to a wind center of the compression coil spring 27. Accordingly, a stable force is applied from the compression coil spring 27 to the metal sheet 29, so that the pressure from the cleaning blade 15 to the photosensitive drum 1 is stabilized.

As in Comparative Example illustrated in FIG. 3B, in the compression coil spring of which the front end is not formed in an inclined state, the compression coil spring is easily curved when assembling the cleaning blade 15, and hence the pressure application side is not stabilized. For this reason, it is difficult to equalize the pressure. Here, the invention is not limited to the configuration of FIG. 3A, and the configuration of FIG. 3B may be employed.

As illustrated in FIG. 3A, it is desirable that the angle θ of the front end 27*a* with respect to a bottom surface 27*b* (a surface perpendicular to the longitudinal direction of the compression coil spring 27 at the opposite end of the front end 27*a*) of the compression coil spring 27 of the embodiment is in the range 1 to 30°. When the angle θ is smaller than 1° or the angle θ is larger than 30°, the compression coil spring 27 is easily curved when applying a pressure to the subject, so that the evenness of the pressure may not be obtained. Specifically, when the angle θ is set in the range of 1 to 30°, the compression coil spring 27 may be assembled without being curved and hence the pressure may be easily equalized.

Figure 4:
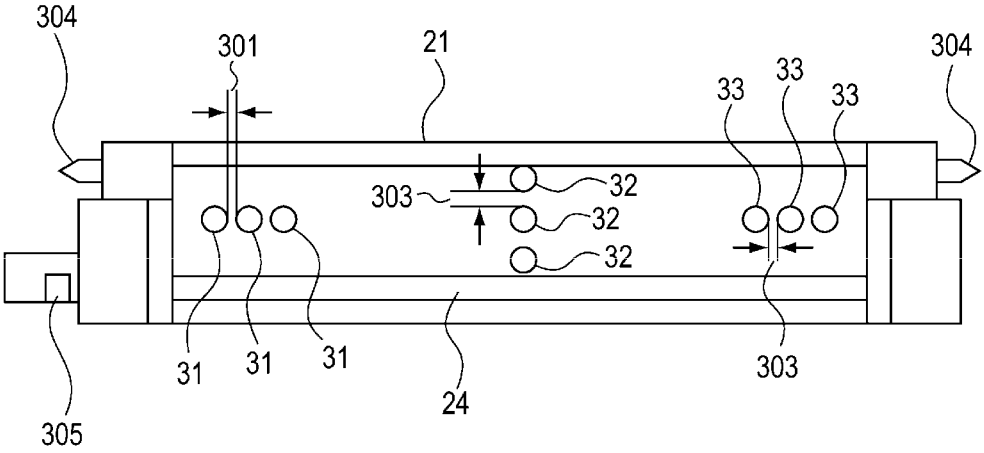
FIG. 4 is a front view illustrating a frame body from which a cleaning blade and a compression coil spring according to the embodiment are separated.

FIG. 4 is a front view illustrating the frame body 21 from which the cleaning blade 15 is separated. As illustrated in FIG. 4, the frame body 21 is provided with a positioning shaft 304 which positions the cleaning device 14 and a discharge port 305 from which the collected residual toner is discharged.

Further, the frame body 21 is provided with a plurality of bosses (restricting portions) 31, 32, and 33 which fixes the compression coil spring 27. Three bosses 31 are arranged at one end of the cleaning blade 15 in the longitudinal direction with a gap 301 therebetween in the longitudinal direction. Three bosses (restricting portions) 33 are arranged at the other end of the cleaning blade 15 in the longitudinal direction with a gap 303 therebetween in the longitudinal direction. Three bosses 32 are arranged at the center of the cleaning blade 15 in the longitudinal direction with a gap 302 therebetween in a direction perpendicular to the longitudinal direction.

Figure 5:
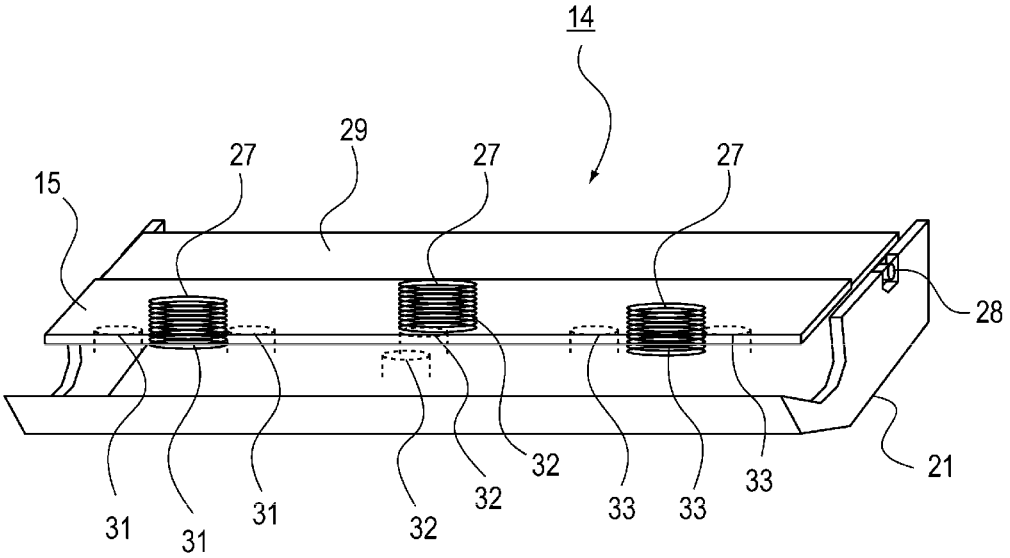
FIG. 5 is a diagram illustrating a state where the compression coil spring is attached to a boss according to the embodiment.

FIG. 5 is a diagram illustrating a state where the compression coil springs 27 are attached to the bosses 31 to 33. As illustrated in FIG. 5, the compression coil springs 27 are respectively fitted to one of three bosses 31, one of three bosses 32, and one of three bosses 33. The selection of the boss fitted with the compression coil spring 27 is performed so that the pressure from the cleaning blade 15 to the photosensitive drum 1 in the longitudinal direction becomes even.

Specifically, the pressure at the center in the longitudinal direction may be increased by selecting the boss near the center in the longitudinal direction in the set of bosses 31 and 33. Further, the pressure at the center in the longitudinal direction may be increased by selecting the boss 32 near the swing shaft 28 in the set of bosses 32.

Further, the gap 302 of the boss 32 at the center in the longitudinal direction is wider than the gaps 301 and 303 of the bosses 31 and 33 at the ends in the longitudinal direction. Since a change in the pressure at the center in the longitudinal direction is basically large, the precision of the pressure may be obtained by the gap wider than those of the ends. Further, the gaps 301 and 303 at the ends are narrowed so that the left and right balances are minutely changeable.

Furthermore, in the embodiment, each number of the bosses 31 to 32 is set to three, but in the invention, it is not limited to three. Further, the diameters of the bosses 31 and 32 may be 1 to 10 mm and desirably, 2 to 8 mm. When the diameter is smaller than 1 mm, the compression coil spring 27 is thinned, so that a stable force cannot be applied to the metal sheet 29. Further, when the diameter is larger than 10 mm, the pressure weighted range increases, so that the unevenness of the pressure increases. Specifically, when the diameters of the bosses 31 and 32 are set to 1 to 10 mm and desirably, 2 to 8 mm, a stable force may be applied to the cleaning blade 15, so that the unevenness of the pressure may be suppressed.

Figure 6:
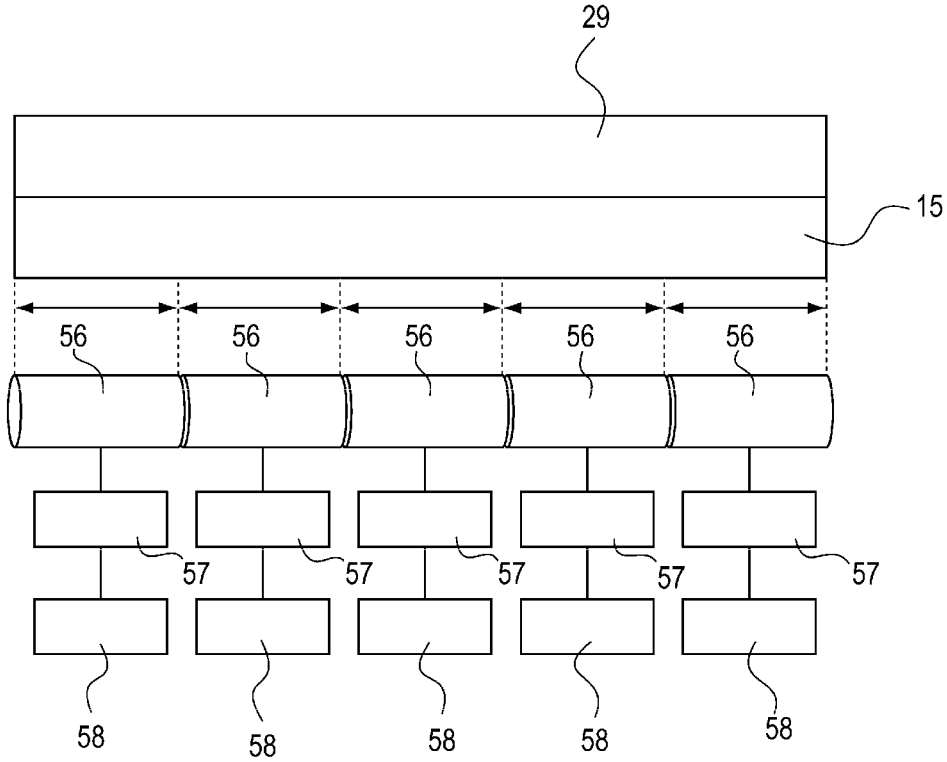
FIG. 6 is a diagram illustrating a method of measuring an evenness of a pressure of the compression coil spring according to the embodiment.

FIG. 6 is a diagram illustrating a method of measuring the evenness of the pressure of the compression coil spring according to the embodiment. As illustrated in FIG. 6, a pressure sensor 57 is attached to each of five imaginary drums 56 divided into five in the longitudinal direction of the cleaning blade 15. Then, the pressures which are detected by five pressure sensors 57 are digitally displayed on elements 58. Accordingly, the distribution of the pressure in the longitudinal direction of the cleaning blade 15 is measured.

It is desirable that the abutting pressure of the cleaning blade 15 against the photosensitive drum 1 be set so that the difference between the maximum value and the minimum value of the measurement values measured at five divided positions in the longitudinal direction is within 0.1 N and desirably, within 0.07 N. When the difference is within 0.1 N and desirably, within 0.07 N, it is possible to equalize the pressure for a long period of time and to stably maintain the pressure with a simple configuration. Accordingly, it is possible to suppress the uneven scraping and to perform a satisfactory image forming operation for a long period of time.

Figure 7:
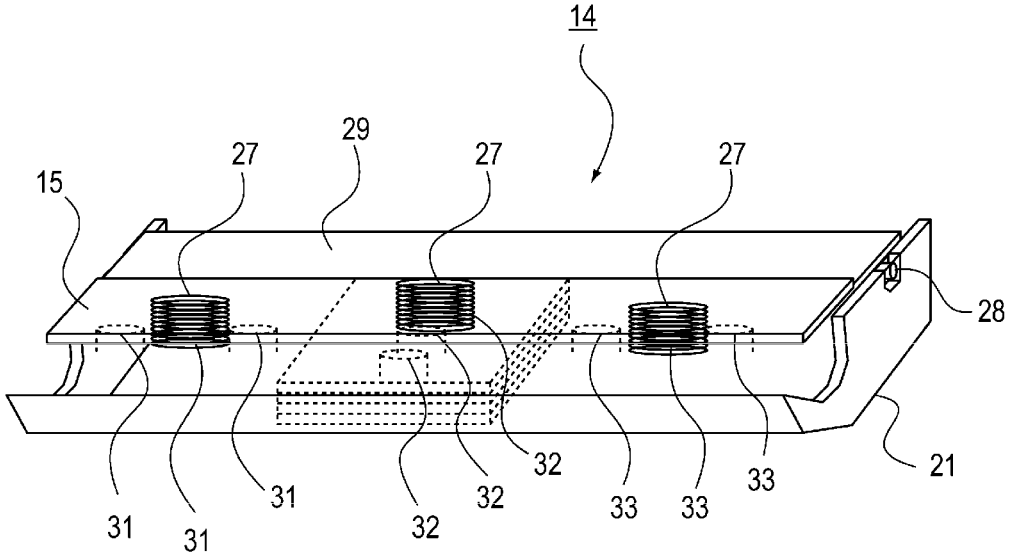
FIG. 7 is a diagram illustrating another method of equalizing a pressure of the cleaning blade.

Furthermore, as another method of equalizing the pressure of the cleaning blade 15, as illustrated in FIG. 7, a bottom portion of the frame body 21, as a multi-structure capable of adjusting the thickness (the compression amount of the compression coil spring 27), may be provided in the portion of the frame body 21 provided with the boss 32. When the thickness of the bottom portion is thickened, the pressure of the compression coil spring 27 increases. In this way, since the pressure of the compression coil spring 27 at the center in the longitudinal direction may be adjusted by adjusting the thickness of the bottom portion, the pressure may be equalized.

(Photosensitive Drum 1) A HU (universal hardness value) and an elastic deformation rate were measured by using a minute hardness measuring device: FISCHER SCOPE H100V (manufactured by Fischer Corporation). FISCHER SCOPE H100V (manufactured by Fischer corporation) may continuously obtain hardness by continuously applying a load to an indenter and directly reading a pressing depth under the load. As the indenter, a Vickers quadrangular diamond indenter of a facing angle 136° was used. The condition of the load was gradually measured up to the final load of 6 mN (273 points for the holding time as 0.1 s of each point).

Figure 8:
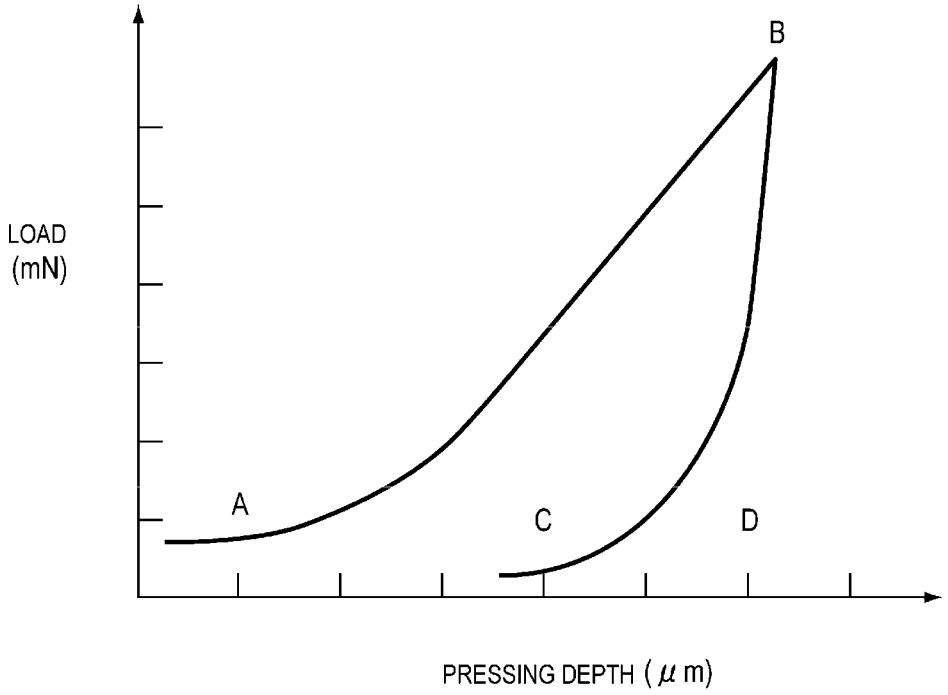
FIG. 8 is a diagram illustrating an output chart of FISCHER SCOPE H100V (manufactured by H. Fishere Corporation)

FIG. 8 is a diagram illustrating an output chart of FISCHER SCOPE H100V (manufactured by H. Fishere Corporation). The vertical axis indicates the load (mN) and the horizontal axis indicates the pressing depth h (μm). This is the result in which the load is gradually increased to 6 mN and the load is gradually decreased similarly.

The HU (universal hardness value: hereinafter, referred to as HU) is defined by the following equation (Equation 1) from the pressing depth under the same load during the pressing operation of 6 mN.

$$HU = \frac{\text{TEST LOAD } (N)}{\text{SURFACE AREA (mm}^2\text{) OF VICKERS INDENTER}} = \frac{0.006}{26.43\ h^2}(N/\text{mm}^2) \quad \text{[Equation 1]}$$

$h$: PRESSING DEPTH (mm) UNDER TEST LOAD

The elastic deformation rate is obtained from a change in energy due to an increase and decrease in the load of the indenter with respect to the film, that is, the amount of work (energy) of the indenter with respect to the film. The elastic deformation rate is obtained by the equation of We/Wt×100 (%). The total work amount Wt (nW) is indicated by the area surrounded by A-B-D-A in FIG. 8. The work amount We (nW) of the elastic deformation is indicated by the area surrounded by C-B-D-C in FIG. 8.

As the performance needed in the organic electro-photographic photoreceptor (photosensitive drum 1), the improvement in durability with respect to mechanical deterioration may be exemplified. In general, the hardness of the film becomes higher as the deformation amount against the external stress becomes smaller, and the electro-photographic photoreceptor may have improved durability with respect to mechanical deterioration when the pencil hardness or Vickers hardness is high. However, the photoreceptor with high hardness obtained by the measurement may not improve the durability at all times.

As a result of a careful examination, we found that mechanical deterioration hardly occurs on a surface layer of the photoreceptor when the values of the HU and the elastic deformation rate are in a certain range. Specifically, the hardness test was performed by employing the Vickers quadrangular diamond indenter. The hardness was significantly improved by using an electro-photographic photoreceptor whose HU, when pressing the indenter at the maximum load of 6 mN, was from 150 N/mm$^2$ to 220 N/mm$^2$ and the elastic deformation rate was from 40% to 65%. Further, the hardness characteristic may be further improved when the HU value is from 160 N/mm$^2$ to 200 N/mm$^2$.

The HU and the elastic deformation rate may not be separately recognized. However, for example, if the elastic deformation rate is less than 40% when the HU exceeds 220 N/mm$^2$, the paper dust or the toner is interposed in the cleaning blade 15 or the charging roller 2. Accordingly, if the elastic deformation rate is larger than 65%, the elastic deformation rate is high, but the elastic deformation amount is small due to the small elasticity of the photosensitive drum 1. Thus, a large pressure is applied to a local position of the photosensitive drum, and hence a deep scar occurs in the photosensitive drum. Accordingly, it is considered that the large HU value is not optimal for the photosensitive drum 1 at all times.

Further, if the elastic deformation rate exceeds 65% when the HU is less than 150 N/mm$^2$, the plastic deformation amount is also large even when the elastic deformation rate is high. Accordingly, the paper dust or the toner interposed in the cleaning blade 15 or the charging roller 2 frictionally scrapes the photosensitive drum 1 or generates a minute scar thereon.

The photosensitive drum 1 which is used in the invention is formed by an electro-photographic photoreceptor, at least the surface layer of which includes a compound that is cured by polymerizing or cross-linking Furthermore, as a curing means, heat, light such as visible light or UV light, and radiation may be used.

Accordingly, in the embodiment, as a method of forming the surface layer of the photosensitive drum 1, a coating solution containing a dissolved compound that can be cured by polymerizing or cross-linking and is used for the surface layer is coated onto the surface layer by an immersion coating method, a spray coating method, a curtain coating method, a spin coating method, or the like and the coated compound is cured by a curing means.

Among these methods, as a method of efficiently and massively manufacturing the photosensitive drum 1, the immersion coating method is the most desirable, and in the embodiment, an immersion application method may be employed.

Figure 9A:
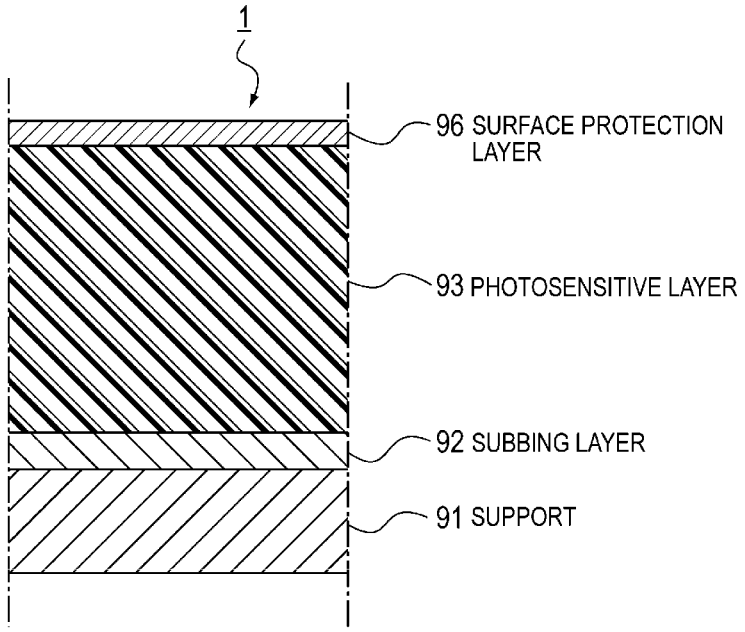
FIGS. 9A and 9B are configuration diagrams illustrating a photosensitive drum according to the embodiment.
Figure 9B:
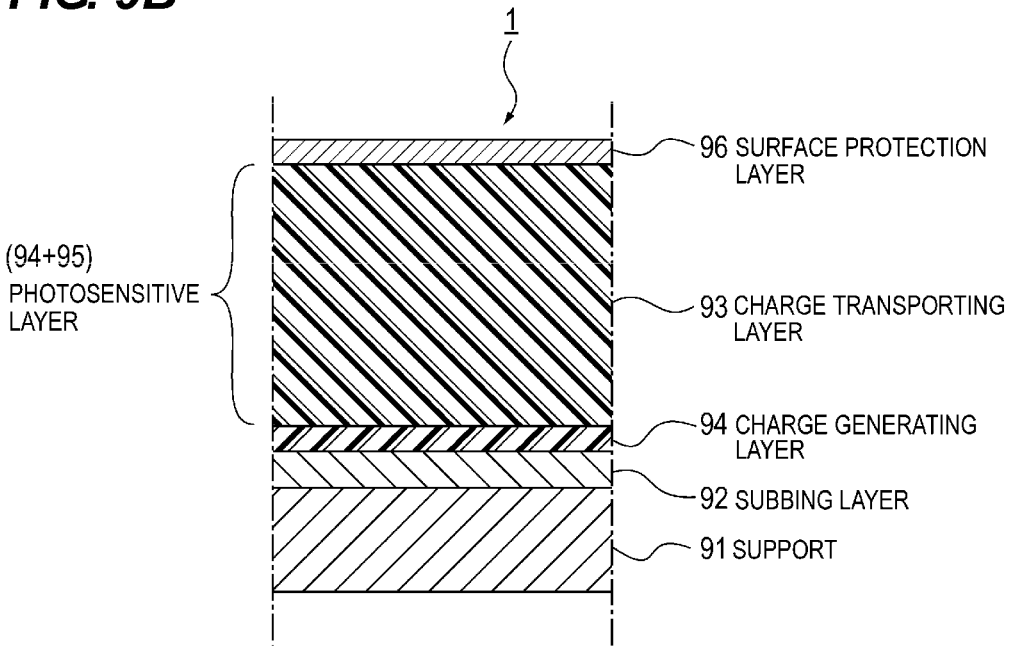

FIGS. 9A and 9B are configuration diagrams illustrating the photosensitive drum 1 according to the embodiment. FIG. 9A illustrates the single layer type photosensitive drum 1 in which both a charge generating material and a charge transporting material are included in the same photosensitive layer 93 on the conductive base (support) 91 having an outer diameter of, for example, 30 mm. FIG. 9B illustrates a lamination type photosensitive drum in which a charge generating layer 94 including a charge generating material and a charge transporting layer 95 including a charge transporting material are laminated on the support 91 in this order or the opposite order. A surface protection layer 96 may be formed on the photosensitive layer 93.

Further, in the embodiment, at least the surface layer of the photosensitive drum 1 may include a compound which may be cured by polymerizing or cross-linking through heat, light such as visible light or UV light, and radiation. Then, desirably, from the viewpoint of the characteristics of the photosensitive drum 1, and particularly, the electric characteristic such as a residual charge and durability, a function separation type photoreceptor which is formed by sequentially laminating the charge generating layer 94 and the charge transporting layer 95 is desirable. Alternatively, the surface protection layer 96 may be further laminated on the photosensitive layer 93 of the function separation type photoreceptor (FIG. 9B).

In the embodiment, as a method of curing the compound by polymerizing or cross-linking in the surface layer, radiation is used since the deterioration in the photoreceptor characteristics is small, the residual charge does not increase, and the sufficient hardness is obtained.

As the radiation that is used to generate polymerizing or cross-linking, an electron ray or a gamma ray is desirable. Among these, when the electron ray is used, an accelerator of any type such as a scanning type, an electron curtain type, a broad beam type, a pulse type, and a laminar type may be used.

Further, when the electron ray irradiates the subject, as the irradiation condition for exhibiting the electric characteristics and the durability of the photosensitive drum 1 according to the embodiment, the acceleration voltage is desirably set to 250 kV or less and is more desirably set to 150 kV or less. Further, the irradiation dose is desirably set to the range from 10 kJ/kg to 1000 kJ/kg and is more desirably set to the range from 15 kJ/kg to 500 kJ/kg.

When the acceleration voltage is larger than the upper limit of the above-described range, there is a tendency that a so-called damage caused by the irradiation of the electron ray with respect to the photoreceptor characteristics increases. Further, when the irradiation dose is smaller than the lower limit of the above-described range, the insufficient curing may be easily performed. Further, since deterioration in the photoreceptor characteristics easily occurs when the radiation does is large, it is desirable that the radiation does is selected in the above-described range from this viewpoint.

Further, as the compound which can be cured by polymerizing or cross-linking and is used for the surface layer, it is desirable that an unsaturated polymerizable functional group is included in a molecule from the viewpoint in the degree of the reactivity, the reaction speed, and the degree of the hardness obtained after curing.

Furthermore, even in the molecule including the unsaturated polymerizable functional group, in particular, a compound including an acrylic group, a methacrylic group, and a styrene group is desirable.

Further, as the compound including the unsaturated polymerizable functional group according to the embodiment, the compound is broadly classified into a monomer and an oligomer due to the repeated state of the constituent unit. The monomer indicates a polymer, the constituent unit of which, including the unsaturated polymerizable functional group, is not repeated and the molecular weight is comparatively small. Meanwhile, the oligomer indicates a polymer, the constituent unit of which, including the unsaturated polymerizable functional group, is repeated about 2 to 20 times. Further, a so-called macronomer, which is formed by linking the unsaturated polymerizable functional group only to the end of the polymer or the oligomer, may be used as a curing compound for a surface layer according to the first embodiment.

Further, in order that the compound including the unsaturated polymerizable functional group according to the embodiment satisfies the charge transporting function needed in the surface layer, it is more desirable that a charge transporting compound is employed as the compound. Even in the charge transporting compound, an unsaturated polymerizable compound including a hole transporting function is more desirable.

Specifically, as the support 91 of the photosensitive drum 1, a conductive support is desirable. Specifically, for example, exemplified are a support which is formed in a drum shape or a sheet shape by metal such as aluminum, copper, chrome, nickel, zinc, and stainless or alloy thereof, a support which is formed by laminating a metal foil of aluminum and copper on a plastic film, a support which is formed by depositing aluminum, indium oxide, and tin oxide on a plastic film, or a metal sheet, a plastic film, or paper provided with a conductive layer which is formed by coating only a conductive material or a conductive material and a binding resin.

Further, in the embodiment, a subbing layer 92 including a barrier function and an adhering function may be provided on the surface of the conductive support 91.

The subbing layer 92 is a layer which is formed so as to improve the adhesiveness of the photosensitive layer, to improve the coating property, to protect the support, to coat the defect on the support, to improve the charge injection property from the support, or to protect against the electric breakage of the photosensitive layer.

As the material of the subbing layer 92, polyvinyl alcohol, poly-N-vinyl imidazole, polyethylene oxide, ethyl cellulose, ethylene-acrylic acid copolymer, casein, polyamide, N-methoxymethylated 6 Nylon, copolyamide, glue, gelatin, and the like may be used. Such a material is dissolved in each appropriate solvent and is coated on the surface of the support. Then, the film thickness of the subbing layer is appropriately from 0.1 to 2 μm.

In a case where the photosensitive drum 1 is the function separation type photoreceptor, the charge generating layer 94 and the charge transporting layer 95 are laminated. As the charge generating material which is used in the charge generating layer 94, exemplified are selenium-tellurium (Se—Te), pyridium, tiapyrylium-based dye, or various kinds of central metal and crystalline systems, specifically, for example, a phthalocyanine-based compound, an anthanthrone pigment, a dibenzpyrenequinone pigment, a pyranthrone pigment, a trisazo pigment, a disazo pigment, a monoazo pigment, an indigo pigment, a quinacridone pigment, an asymmetrical quinocyanine pigment, quinocyanine, and amorphous silicon with crystalline forms of α, β, γ, ϵ, and X.

Further, in a case of the function separation type photoreceptor, the charge generating layer 94 is formed in a manner such that the charge generating material is satisfactorily dispersed together with a binding resin and a solvent 0.3 to 4 times the amount of the charge generating material by a means such as a homogenizer, an ultrasonic dispersion means, a ball mill, a vibration ball mill, a sand mill, an attritor, and a roll mill and a dispersion liquid is coated and dried. Alternatively, the charge generating layer is formed as a separate film such as a deposited film of a charge generating material. Here, the film pressure of the charge generating layer 94 is typically 5 μm or less and appropriately from 0.1 to 2 μm.

Further, in an example in which the binding resin is used, exemplified are polymer and copolymer of a vinyl compound such as styrene, vinyl acetate, vinyl chloride, acrylic acid ester, methacrylic acid ester, vinylidene fluoride, and trifluoroethylene, polyvinyl alcohol, polyvinyl acetal, polycarbonate, polyester, polysulfone, polyphenylene oxide, polyurethane, a cellulose resin, a phenol resin, a melanin resin, a silicone resin, an epoxy resin, and the like.

The hole transporting compound including the unsaturated polymerizable functional group according to the embodiment may be used as the charge transporting layer 95 on the above-described charge generating layer 54. Alternatively, the hole transporting compound may be used as the surface protection layer 96 after the charge transporting layer 55 or the charge transporting layer 55 including the binding resin is formed on the charge generating layer 94.

Then, in a case where the hole transporting compound is used as the surface protection layer 96, the charge transporting layer 95 corresponding to the sub-layer may be formed in a manner such that a solution obtained by dispersing or dissolving an appropriate charge transporting material, for example, a high-molecular compound including a hetero ring or a condensed polycyclic aromatic group such as poly-N-vinylcarbazole or polystyrene anthracene, a heterocyclic compound such as pyrazoline, imidazole, oxadole, triazole, or carbazole, or a low-molecular compound such as triarylamine derivative of triphenylamine, phenylene diamine derivative, N-phenylcarbazole derivative, stilbene derivative, and hydrazone derivative into a solvent together with an appropriate binding resin selectable from the resin for the above-described charge generating layer is coated according to the above-described known method and is dried.

As for the ratio between the charge transporting material and the binding resin in this case, when the total weight of both the charge transporting material and the binding resin is set to 100, it is desirable that the weight of the charge transporting material be in the range from 30 to 100 and it is more desirable that the weight be appropriately selected in the range from 50 to 100.

When the weight of the charge transporting material in the charge transporting layer 95 is smaller than such a range, there is a problem in that the charge transporting function is degraded, the sensitivity is degraded, or the residual charge increases. Even in this case, the thickness of the photosensitive layer 93 is in the range from 5 to 30 μm. Further, the film thickness of the photosensitive layer 93 at this time is obtained by adding the respective film thicknesses of the charge generating layer 94, the charge transporting layer 95, and the surface protection layer 96.

In any case, the method of forming the surface layer is generally performed in a manner such that a solution including the hole transporting compound is coated and polymerized or cured. Furthermore, the surface layer may be formed in a manner such that a cured material is obtained by the reaction of the solution including the hole transporting compound in advance and is dispersed or dissolved in the solvent again.

Further, as a method of coating the above-described solution, an immersion coating method, a spray coating method, a curtain coating method, and a spin coating method are known. Then, from the viewpoint of the efficiency and the productivity, the immersion coating method is desirable as the method of coating the solution. Furthermore, other known film forming methods such as a deposition or a plasma treatment may be appropriately selected.

Further, a conductive particle may be mixed in the surface protection layer 96 according to the embodiment. As the conductive particle, metal, metal oxide, and carbon black may be exemplified.

As the metal of the conductive particle, specifically, aluminum, zinc, copper, chrome, nickel, stainless, and silver may be exemplified. Further, as the conductive particle, such metal may be deposited on the surface of a plastic particle.

Further, as the metal oxide of the conductive particle, specifically, zinc oxide, titanium oxide, tin oxide, antimony oxide, indium oxide, bismuth oxide, tin-doped indium oxide, antimony-doped tin oxide, and antimony-doped zirconium oxide may be exemplified.

Further, the metal oxides may be used solely or in combination of two types or more. Furthermore, in the case of the combination of two types or more, the metal oxides may be simply mixed with each other or solid dispersion or fusion thereof may be performed.

Further, the average particle diameter of the conductive particle used in the embodiment is desirably 0.3 μm or less and more desirably 0.1 μm or less from the viewpoint of the transparency of the surface protection layer 96. Further, in the material of the above-described conductive particle, the metal oxide is particularly desirable from the viewpoint of the transparency.

The ratio of the conductive metal oxide particle in the surface protection layer 96 is one factor that directly determines the resistance of the surface protection layer 96. Accordingly, it is desirable that the specific resistance of the surface protection layer 96 be in the range of $10^8$ to $10^{13}$ Ωm ($10^{10}$ to $10^{15}$ Ωcm).

Further, in the embodiment, a fluororesin particle may be included in the surface layer. As the fluororesin particle, it is desirable that at least one type be appropriately selected from a tetrafluoroethylene resin, a trifluorochloroethylene resin, a hexafluoroethylene propylene resin, a vinyl fluoride resin, a vinylidene fluoride resin, a difluorodichloroethylene resin, and a copolymer of these.

Then, as the above-described fluororesin particle, particularly, a tetrafluoroethylene resin and a vinylidene fluoride resin are desirable. Furthermore, the molecular weight or the particle diameter of the resin particle may be appropriately selected and the invention is not essentially limited to the above-described molecular weight or the above-described particle diameter.

The ratio of the fluororesin particles in the surface layer with respect to the total weight of the surface layer is typically 5 to 40 wt % and is appropriately 10 to 30 wt %. This is because the mechanical strength of the surface layer may be easily degraded when the ratio of the fluororesin particles is larger than 40 wt % and the toner parting property of the surface of the surface layer and the abrasion resistance or the scuffing resistance of the surface layer may be not sufficient when the ratio is smaller than 5 wt %.

In the embodiment, in order to further improve the dispersibility, the binding property, and the weather proofing, an additive such as a radical capturing agent or an antioxidizing agent may be added into the surface layer. Further, in the first embodiment, the film thickness of the surface protection layer is appropriately in the range from 0.2 to 10 μm and is more appropriately in the range from 0.5 to 6 μm.

Further, the surface shape is an important point of the invention, but it is characterized in that the surface is basically polished. In the polished state, it is important that the surface roughness (Rz: ten-point average roughness [JISB0601-1982]) is from 0.2 to 2 μm. When the surface roughness is 0.2 μm or less, the inorganic powder is not smoothly inserted into the polishing marks and the polishing agent is not effective. Further, when the surface roughness is larger than 2 μm, the size of the scar appears on the image, so that a defective image is obtained.

Further, as a polishing means, a polishing method using a polishing tape (lapping paper), a polishing method using a polishing roller, a polishing method using a magnetic powder, a polishing method such as buffing, or a polishing method of the combination thereof may be used, and the invention is not limited thereto. It is desirable to appropriately select the method so as to control the desired surface shape.

In particular, the method of polishing the photosensitive drum 1 of the invention was performed by using a polishing device (not illustrated) in a manner such that an elastic roller having a polishing tape wound thereon was rotated while being pressed against the rotating photosensitive drum 1 and the polishing tape was reeled out by a predetermined amount so as to adjust the polishing degree. As the polishing tape used herein, a lapping tape LT-C2000 having SiC as a polishing particle was used, but $AL_2O_3$ or $Fe_2O_3$ may be used as the polishing particle.

As the method of obtaining the scraping amount of the photosensitive drum 1 according to the invention and a method of measuring the scraping amount, the above-described photoreceptor (30 Φ) is inserted into an electro-photographic device (for example, iR2545 [manufactured by Canon Corporation]), a sheet passing test is performed by intermittently printing an image of a toner applied amount of 0.025±0.015 g/A4 size onto one sheet in a normal environment (20° C./50%), the film thickness of the surface layer is measured by an eddy current type film thickness gauge (manufactured by Fisher Corporation), and the scraped amount is calculated by the comparison with the initial film thickness. When the number is divided by the sheet passing number and the unit is set as μm/ten thousand sheets, the scraping amount is obtained. It is desirable that the scraping amount of the photoreceptor be from 0.01 μm to 0.5 μm/ten thousand sheets. More desirably, the scraping amount is from 0.05 μm to 0.3 μm/ten thousand sheets. When the scraping amount is less than 0.01 μm/ten thousand sheets, the scraping substantially does not occur. For this reason, it is not possible to prevent the torque-up just by the lubrication effect of the toner due to the large influence of the condition of the charging product. Further, when the scraping amount is larger than 0.5 μm/ten thousand sheets, the scraping amount is larger than the case of 5 μm/one hundred sheets, and the long life time is not sufficiently ensured.

EXPERIMENT

FIG. 10 is a Diagram illustrating a test result of Examples 1 to 3 using the invention and Comparative Examples 1 to 4.

Example 1

The cleaning device 14 of Example 1 using the invention prepares a sheet for the cleaning blade according to the following composition. The composition was set such that Polyesterpolyol (trade name: NIPPOLLAN, manufactured by Nippon Polyurethane Industry Co., Ltd.): 100 parts by weight, 4,4'-diphenyl methane diisocyanate (MDI): 41 parts by weight, and 1,4-butanediol: 6 parts by weight.

After polyesterpolyol was subjected to a dewatering process, 4,4'-diphenyl methane diisocyanate (MDI) was mixed therewith and was heated for 20 minutes at 115° C., thereby obtaining prepolymer. A mixture was obtained by adding 1,4-butanediol to the prepolymer. A sheet-like material was prepared from the mixture by using a centrifugal molding machine.

The sheet had a thickness of 2 mm, a hardness of 70° (JISA), and a permanent deformation of 0.5%. The sheet was cut into a predetermined size in a shape of a strip, and an adhesive (trade name: EP-001, manufactured by Cemedine Co., Ltd.) of 100 μm was heat-fused to a position of 4 mm of an upper portion of a phosphatized steel plate (trade name: bonderizing plate, manufactured by Nippon Steel Corporation) at 80° C., thereby obtaining the cleaning blade 15.

The cleaning blade 15 was used and the compression coil spring 27 (having a spring constant of 1 N/mm, a diameter of 4 mm, and a front end angle of) 15° was set to each center boss of the three positions of the bosses 31 to 33.

The pressure was measured, and the difference between the maximum value and the minimum value of the measurement value measured at five divided positions in the longitudinal direction was 0.4 N. For this reason, the compression coil spring 27 set to the center boss 32 of the middle bosses 32 in the longitudinal direction was moved to the upper boss 32 near the swing shaft 28 and the difference was measured again. As a result, the difference between the maximum value and the minimum value at the five divided positions was 0.05 N. The photosensitive drum 1 using the cleaning blade 15 with this configuration was prepared as below. The assembling at this time was very easy.

Next, as the photosensitive drum 1, two aluminum cylinders of 30ϕ (thrust length of 360 mm) for the hardness test and the actual machine test were prepared. The coating material for the conductive layer was adjusted by the following order. A conductive titanium oxide powder coated by tin oxide including 10% of antimony oxide: 50 parts by weight, a phenol resin: 25 parts by weight, methyl cellosolve: 20 parts by weight, methanol: 5 parts by weight, silicone oil (polydimethysiloxane polyoxyalkylene copolymer) having an average molecular weight of 3000: 0.002 parts by weight were dispersed and adjusted for 2 hours by a sand mill device using glass beads of ϕ1 mm. The coating material was coated onto the aluminum cylinder by the immersion coating method, and was dried for 30 minutes at 140° C., thereby forming a conductive layer having a film thickness of 20 μm.

Next, N-methoxymethylated nylon: 5 parts by weight was dissolved in methanol: 95 parts by weight so as to adjust the coating material for the intermediate layer. The coating material was coated onto the above-described conducive layer according to the immersion coating method, and was dried for 20 minutes at 100° C., thereby forming an intermediate layer of 0.6 μm.

Next, oxytitanium phthalocyanine of which the Bragg angle of 2θ±0.2 in X-ray diffraction of CuKα has a strong peak at 9.0°, 14.2°, 23.9°, and 27.1°: 3 parts by weight, polyvinyl butyral (trade name: S-LEC BM2, manufactured by Sekisui Chemical Co., Ltd.): 3 parts by weight, and cyclohexanone: 35 parts by weight were dispersed for 2 hours by a sand mill device using glass beads of ϕ1 mm and ethyl acetate: 60 parts by weight was added thereto, thereby preparing a coating material for a charge generating layer. The coating material was coated onto the intermediate layer by the immersion coating method and was dried for 10 minutes at 50° C., thereby forming a charge generating layer having a film thickness of 0.2 μm.

After the charge generating layer is formed, a styryl compound of the following structural formula (Chemical formula 1): 10 parts by weight and a polycarbonate resin having a repeated unit of the following structural formula (Chemical formula 2): 10 parts by weight were dissolved in the mixed solvent of monochlorobenzene: 50 parts by weight and dichloromethane: 30 parts by weight, thereby adjusting an coating liquid for a charge transporting layer. The coating liquid was coated onto the charge generating layer by the immersion coating and was dried for 1 hour at 120° C., thereby forming a charge transporting layer having a film thickness of 20 μm.

[Chemical formula 1]

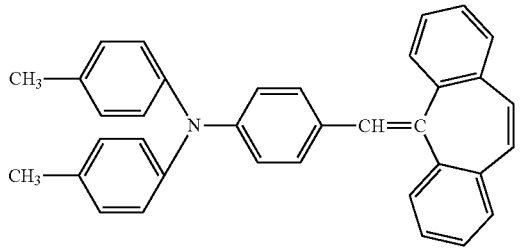

[Chemical formula 2]

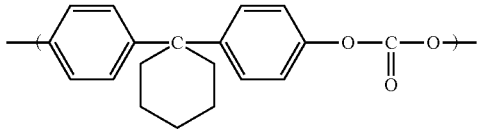

(Mv ≒ 20000)

Subsequently, the hole transporting compound of the following structural formula (Chemical formula 3): 60 parts by weight was dissolved in the mixed solvent of monochlorobenzene: 50 parts by weight and dichloromethane: 50 parts by weight, thereby adjusting a coating material for a protection layer. In the coating material for the protection layer, a tetrafluoroethylene resin of 30 wt % was included as the fluororesin particle with respect to the total weight of the protection layer.

After the coating liquid was coated onto the above-described charge transporting layer, both ends (the portions of 32.5 mm from both ends) of the drum cylinder were masked so that an electron ray was not irradiated thereto since the image forming region (developing region) was 295 mm, and the electron ray was irradiated with the condition of the acceleration voltage of 150 KV and the irradiation dose of 50 KGy under the atmosphere of the oxygen density of 10 ppm. Subsequently, the masking was removed and a heat treatment was performed for 10 minutes so that the temperature of the photoreceptor became 100° C. under the same atmosphere, and then a protection layer having a film thickness of 5 μm was formed, thereby obtaining the photosensitive drum 1.

After the photosensitive drum 1 for the hardness test was held at the environment of the humidity of 50% for 24 hours at 25° C., the HU (universal hardness value) was 190 N/mm$^2$ and the We (elastic deformation rate) was 46% when obtaining the HU and the elastic deformation rate using the above-described minute hardness measuring device: FISCHER SCOPE H100V (manufactured by Fischer corporation).

The photosensitive drum 1 for a test was inserted into iR2545 (manufactured by Canon Corporation), a sheet passing image test (hundred thousand sheets) was performed by intermittently printing an image of a toner applied amount of 0.025 g/A4 size onto one sheet in a normal environment (20° C./50%), and the film thickness of the surface layer was measured by the eddy current type film thickness gauge (manufactured by Fisher Corporation). At this time, the scraping amount of the image forming region was 0.1 μm/ten thousand sheets.

As the result of the sheet passing durability test, a defective image caused by the unevenness of the scraping did not occur even when hundred thousand sheets passed, and high durability was obtained while satisfying the requirement of a stable cleaning performance.

Example 2

In Example 2 using the invention, a bottom raising of 2 mm was performed by the bottom portion as illustrated in FIG. 7 in Example 1, and the compression coil springs 27 were set to the center bosses in all the bosses 31 to 33. Then, the same sheet passing image test as that of Example 1 was performed.

The difference between the maximum value and the minimum value at five divided positions in Example 2 was 0.02 N. The scraping amount of the image forming region at this time was 0.1 μm/ten thousand sheets.

As the result of the sheet passing durability test, the above-described problem does not occur even when hundred thousand or more sheets passed. Further, the cleaning blade 15 was not turned up while satisfying the cleaning performance and the high durability was obtained.

Example 3

In Example 3 using the invention, as the spring constant of the compression coil spring 27 of Example 1, the compres-

[Chemical formula 3]

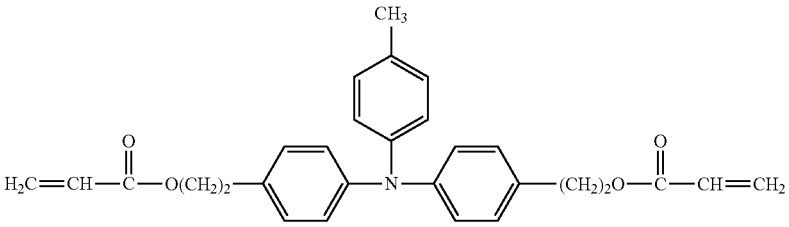

sion coil spring 27 at the end in the longitudinal direction had a spring constant of 1 N/mm and a diameter of 4 mm and the compression coil spring 27 at the center in the longitudinal direction had a spring constant of 1.2 N/mm and a diameter of 4 mm. Then, the same sheet passing image test as that of Example 1 was performed.

A difference between the maximum value and the minimum value at five divided positions in Example 3 was 0.05 N. The scraping amount of the image forming region at this time became 0.1 μm/ten thousand sheets and the scraping amount of the cleaning end became 2.5 μm/ten thousand sheets.

As the result of the sheet passing durability test, the above-described problem does not occur even when hundred thousand or more sheets passed. Further, the cleaning blade was not turned up while satisfying the cleaning performance and the high durability was obtained.

Example 4

A different example from Example 1 will be described. In this Example, cartridges, which may be attachable to different types of products A and B, are prepared, and a plurality of bosses (A-type bosses and B-type bosses) is prepared so as to select the position of the boss pressing the cleaning blade accordance to the type of boss, which depends on the type of product. With such a configuration, a different type of cartridge configuration may be commonly used, and hence there is a merit that the manufacturing cost may be decreased. For example, when the B-type bosses are selected, the center blade pressure increases when the position of the compression coil spring is moved to the inner side, and hence the cleaning performance is improved. For this reason, even in a type that employs a toner (for example, a toner with a high degree of circularity) which is not easily cleaned, a satisfactory cleaning performance may be ensured. Meanwhile, when the A-type bosses are selected, for example, the cleaning pressure may be decreased. For this reason, when a toner which is comparatively easily cleaned is employed, such a configuration may be selected when extending the life of the apparatus is prioritized.

Example 5

In Example 4, an example has been described in which cartridges, which may be attachable to different types of products, are prepared and the position of the boss attached to a spring is selected depending on the type of product. In this Example, the position of the boss pressing the cleaning blade may be selectable for each color product, while the cleaning cartridge for each color product is commonly used and is the same type of cleaning cartridge. For example, when the product is a drum cartridge and the drum cartridge in the body can be a color drum cartridge or a Bk drum cartridge, the position of the compression coil spring of the cleaning cartridge is changed depending on the drum cartridge to which it is attached. With such a configuration, a satisfactory cleaning performance may be ensured by the same cleaning cartridge. In the cartridge illustrated in FIG. 1, the number of sheets printed by the color drum cartridge is smaller than the number of sheets printed by the Bk drum cartridge, and hence the coil spring may be provided at the inner side. Further, the number of sheets printed by the Bk drum cartridge basically increases, and hence the drum with a long life time as in Example 1 may be used as the drum.

The scraping amount of the image forming region of the color cartridge at this time was 2 μm/ten thousand sheets. Further, the scraping amount of the Bk cartridge became 0.1 μm/ten thousand sheets. As the result of the sheet passing durability test as in Example 1, it is found that no cleaning error occurred in the color cartridge with a life time of forty thousand sheets and the Bk cartridge with a life time of hundred thousand sheets, and the same cartridge may be used in a plurality of bodies.

Comparative Example 1

In Comparative Example 1, instead of the compression coil spring 27 and the bosses 31 to 33 of Example 1, a tension coil spring was provided at the end of the metal sheet 29 so as to equalize the pressure. Then, the same sheet passing image test as that of Example 1 was performed.

In Comparative Example 1, a difference between the maximum value and the minimum value at five divided positions was 0.4 N, streaks occurred at the end from the time point of fifty thousand sheets, and a defective image was obtained from the time point of one hundred thousand sheets.

Comparative Example 2

In Comparative Example 2, the bosses 31 to 33 of Example 1 were not provided. Then, the same sheet passing image test as that of Example 1 was performed.

The difference between the maximum value and the minimum value at five divided positions in Comparative Example 1 was 0.2 N. After the use in a long period of time, the compression coil spring 27 was separated from the time point of twenty thousand sheets and a cleaning error occurred, so that the cleaning blade was useless.

Comparative Example 3

In Comparative Example 3, as for the positions of the bosses 31 to 33 in Example 1, the gaps 301 to 303 of the bosses were set to be constant in the boss 32 at the center in the longitudinal direction and the bosses 31 and 33 at the ends in the longitudinal direction. Then, the same sheet passing image test as that of Example 1 was performed.

The difference between the maximum value and the minimum value at five divided positions in Comparative Example 3 decreased to 0.25 N, but a defective image slightly occurred at the time point of about one hundred fifty thousand sheets.

Comparative Example 4

In Comparative Example 4, the front end of the compression coil spring 27 in Example 1 was flatly formed without being inclined. Then, the same sheet passing image test as that of Example 1 was performed.

The difference between the maximum value and the minimum value at five divided positions in Comparative Example 3 increased to 1.25 N, and hence a cleaning error immediately occurred. The cleaning blade was useless, and the assembling workability was the worst.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-014901, filed Jan. 27, 2012, which is hereby incorporated by reference herein in its entirety.

What is claimed is:

1. A cartridge which is detachably attachable to each of a first image forming apparatus and a second image forming apparatus, which is a different type of image forming apparatus having a different structure from the first image forming apparatus, the cartridge comprising:

a frame body;

a cleaning blade which is provided movably inside the frame body and cleans an image bearing member;

a plurality of compression coil springs, which are compressed so as to press the cleaning blade to the image bearing member; and an attaching portion to which the compression coil springs are attached, wherein the attaching portion includes a plurality of regulating portions, to which each of the compression coil springs are attachable, disposed at different positions in a longitudinal direction of the cleaning blade, and wherein the cartridge is configured to permit the compression coil springs to be attached to different ones of the regulating portions in the longitudinal direction of the cleaning blade, depending on whether the cartridge is attached to the first image forming apparatus or to the second image forming apparatus.

2. A cartridge comprising:

a frame body;

a cleaning blade which is provided movably inside the frame body and is configured to clean an image bearing member;

a plurality of compression coil springs, which are compressed so as to press the cleaning blade to the image bearing member; and an attaching portion to which the compression coil springs are attached, wherein the attaching portion includes a plurality of regulating portions, to which each of the compression coil springs are attachable, disposed at different positions in a longitudinal direction of the cleaning blade, and wherein a number of the regulating portions is greater than a number of the compression coil springs, and the compression coil springs are attached to selected ones of the plurality of the regulation portions.

3. The cartridge according to claim 2, wherein the plurality of regulating portions includes a plurality of bosses, wherein the plurality of bosses is provided at a center portion of the frame body in the longitudinal direction thereof and at the longitudinal ends of the frame body in the longitudinal direction, and wherein the thickness of the center portion of the frame body is adjustable so as to adjust the abutting pressure of the cleaning blade on the image bearing member.

4. The cartridge according to claim 2, wherein the plurality of restriction portions is provided at a center portion of the frame body in the longitudinal direction thereof and at longitudinal ends of the frame body in the longitudinal direction thereof, wherein a gap exists between the regulating portions at the center portion of the frame body and a gap exists between the regulating portions at each longitudinal end of the frame body, and wherein the gap between adjacent restriction portions at the center portion of the frame body is wider than the gap between adjacent restriction portions at the longitudinal ends of the frame body.

5. The cartridge according to claim 2, wherein at least one of bearing surfaces of one of the compression coil springs is formed so as to be inclined with respect to a wind center of the compression coil spring.

6. An image forming apparatus comprising:

the image bearing member which bears an electrostatic latent image; and a cartridge according to one of claims 2 and 1, which cleans the image bearing member.

7. The image forming apparatus according to claim 6, wherein a HU (universal hardness value) when pressing a Vickers quadrangular diamond indenter against the image bearing member at a maximum load of 6 mN is from 150 $N/mm^2$ to 220 $N/mm^2$ and an elastic deformation rate of the image bearing member is from 40% to 65% under an environment of a humidity of 50% at 25° C.

* * * * *